US005831381A

United States Patent [19]

Miura et al.

[11] Patent Number: 5,831,381

[45] Date of Patent: Nov. 3, 1998

[54] CATHODE-RAY TUBE HAVING GETTER SPRING THEREIN

[75] Inventors: Toshio Miura, Fukusima; Yoji Kono, Kanagawa, both of Japan

[73] Assignee: Sony Corporation, Tokyo, Japan

[21] Appl. No.: 604,580

[22] Filed: Feb. 21, 1996

[30] Foreign Application Priority Data

Feb. 24, 1995 [JP] Japan ..... 7-037189

[51] Int. Cl.[6] ..... H01J 31/00; H01J 29/10

[52] U.S. Cl. ..... 313/481; 313/461; 313/477 R

[58] Field of Search ..... 313/422, 477 R, 313/415, 416, 407, 408, 481, 461; 315/366

[56] References Cited

U.S. PATENT DOCUMENTS 4,339,694 7/1982 Ohkoshi et al. .
4,588,430 5/1986 Sumiyoshi et al. .
4,754,190 6/1988 Hinotami et al. ..... 313/422
5,493,172 2/1996 Kouno et al. ..... 313/422 X
5,656,885 8/1997 Kohno et al. ..... 313/422 X

FOREIGN PATENT DOCUMENTS 0 238 056 A1 9/1987 European Pat. Off. .

*Primary Examiner*—Sandra L O'Shea
*Assistant Examiner*—Mack Haynes
*Attorney, Agent, or Firm*—Hill & Simpson

[57] ABSTRACT

A flat cathode-ray tube includes a three-component structure of a front panel, a screen panel, and a funnel which are jointed by frit paste. The funnel is inwardly projected from the front panel and the screen panel in the horizontal direction to form a level-difference portion for storing fused frit over the whole inner periphery of the joint surface, whereby occurrence of defected sealing can be decreased, and occurrence of resultant air leakage can be decreased.

12 Claims, 7 Drawing Sheets

CATHODE-RAY TUBE HAVING GETTER SPRING THEREIN

BACKGROUND OF THE INVENTION

1. Field of the Invention

The present invention relates to a flat cathode-ray tube having a fluorescent screen and an electron gun disposed on substantially the same plane to reduce a thickness of a cathode-ray tube.

2. Description of the Related Art

Heretofore, cathode-ray tubes were generally large in depth because an electron gun is disposed on one end and a fluorescent screen is disposed on the other end of its tube body (see FIG. 2B).

As a cathode-ray tube which can solve such a problem, there has heretofore been developed a flat cathode-ray tube having a fluorescent screen 4 and an electron gun 8 disposed on substantially the same plane as shown in FIG. 1. When the flat cathode-ray tube is in use, a viewer, shown by an open arrow in FIG. 1, watches an image formed on the fluorescent screen 4 through a front panel 1 from the side in which electron beams 7 emitted from the electron gun 8 impinge upon the fluorescent screen 4. The flat cathode-ray tube of this type is often referred to as a "reflection-type flat cathode-ray tube". The reflection-type cathode-ray tube has less absorption and scattering on the fluorescent screen 4 itself or the front panel 1, and can obtain high brightness. Therefore, the reflection-type flat cathode-ray tubes are now commercially available as television receivers and monitor receivers using flat tubes, such as a portable flat-type (thin-type) television receiver, a mobile television receiver, or an interphone with a monitor receiver.

On the other hand, there are transmission-type flat cathode-ray tubes in which the viewer watches an image formed on the fluorescent screen 4 from the side opposite to the side in which electron beams 7 emitted from the electron gun 8 impinge upon the fluorescent screen 4. The reflection-type flat cathode-ray tube and the transmission-type flat cathode-ray tube can similarly be applied to the following technique, and hence only the reflection-type flat cathode-ray tube will be described below for the sake of brevity.

As shown in FIG. 2A, the flat cathode-ray tube has a glass bulb of a three-component structure composed of a front panel 1, a screen panel 2, and a funnel 3. The front panel 1, the screen panel 2, and the funnel 3 are fabricated independently, and assembled by the processes of the following order.

(1) Coating frit (solder glass) paste on sealing surfaces (i.e., coating frit paste on the sealing surface of the funnel 3 when the funnel 3, the screen panel 2 and the front panel 1 are joined, and coating frit paste on the sealing surface of the screen panel 2 when the front panel 1 and the screen panel 2 are joined);

(2) Adjusting the positions of the front panel 1, the screen panel 2 and the funnel 3 and pressurizing the same;

(3) Effecting frit-seal (fusing and crystallizing frit paste upon application of heat to fix the sealing surfaces);

(4) Sealing electrode gun (disposing the electron gun 8 within a neck portion 6, and joining a stem portion 5 and the neck portion 6); and (5) Evacuation.

The front panel, the screen panel, and the funnel of the flat cathode-ray tube are joined by frit paste in substantially the same manner as in normal cathode-ray tube, and the process is different only in a three-component structure or in a two-component structure which will be described below.

The glass tube body of the normal cathode-ray tube is of a two-component structure comprising a panel portion 10 and a portion 11 with a funnel portion and a neck portion integrally formed therein as shown in FIG. 2B. Therefore, when the panel portion 10 and the portion 11 are sealed by frit paste, the panel portion 10 and the portion 11, which were separately fabricated, can be easily positioned with accuracy, and uniformly pressurized with ease in frit-seal process.

On the other hand, the glass tube body of the flat cathode-ray tube is of a three-component structure comprising the front panel 1, the screen panel 2 and the funnel 3 as shown in FIG. 2A. Therefore, when the front panel 1, the screen panel 2, and the funnel 3 are joined by frit paste, the front panel 1, the screen panel 2, and the funnel 3 have to be joined simultaneously. For this reason, the front panel 1, the screen panel 2, and the funnel 3 are difficult to be position with accuracy, and it is also difficult to provide uniform pressurized in the frit-seal process. There is then a tendency that defective flat cathode-ray tubes in which glass tube bodies of the front panel 1, the screen panel 2, and the funnel 3 are not joined sufficiently are produced.

In the flat cathode-ray tubes in which the front panel 1 is of a planar front panel shown in FIGS. 1 and 2A, the screen panel 2 is joined at its upper end to the planar front panel 1. As a consequence, it is unavoidable that the back surface portion of the screen panel 2 is extended in length in the vertical direction, and that the side surface portion thereof is increased in depth. An angle θ (see angles θ1, θ2 in FIG. 2A) formed between the long back surface portion and bottom portion of the screen panel 2 is an obtuse angle slightly larger than a right angle in order that the screen panel 2 may easily be withdrawn from a plunger in the press-treatment upon manufacturing.

On the other hand, the top surface, i.e., the sealing surface of the funnel 3, is square in shape because it is preferable to make the top surface of the funnel 3 symmetrical from the request made when a mold of press-treatment is manufactured, and hence the portion corresponding to the angle θ has a right angle. As a result, the screen panel 2 and the funnel 3 are not matched with each other in shape due to a difference of angles, and are difficult to be position with high accuracy. There is then the tendency that defective flat cathode-ray tubes in which glass tube bodies are not joined sufficiently are produced.

The inside of the flat cathode-ray tube is evacuated to produce vacuum after the joint process. When or after the inside of the flat cathode-ray tube is evacuated, flat cathode-ray tubes with glass tube bodies sealed thereto insufficiently become defective due to air-leakage phenomenon in which air enters the flat cathode-ray tube from the outside. In many cases, air-leakage phenomenon is difficult to suppress even when the sealed surfaces are coated with frit paste by another frit-seal process. Moreover, a number of work processes for suppressing occurrence of air-leakage are required, and the flat cathode-ray tube is not so reliable.

OBJECTS AND SUMMARY OF THE INVENTION

It is therefore an object of the present invention to provide a flat cathode-ray tube in which occurrence of insufficient joint of joint surfaces of glass tube bodies composing a cathode-ray tube can be decreased, and occurrence of resultant air-leakage can be decreased.

It is another object of the present invention to provide a flat cathode-ray tube in which occurrence of air-leakage can be reduced by a minimum modification of a flat cathode-ray tube according to the related art.

According to the present invention, there is provided a flat cathode-ray tube having a three-component structure of a front panel, a screen panel and a funnel which are joined by frit paste. Upon frit seal process, the funnel protrudes inward from the front panel and the screen panel to form a level-difference portion for storing fused frit over the whole inner periphery of the sealed surface.

According to the flat cathode-ray tube of the present invention, of the joint surfaces between the funnel and the screen panel, a ratio between a width of a joint surface of a short side of a rectangular sealed surface of a top surface portion of the funnel and a width of a joint surface of a side wall portion of the screen panel is about 1.5:1.0.

According to the flat cathode-ray tube of the present invention, of the joint surfaces between the funnel and the screen panel, a ratio between a width of a long side of a rectangular joint surface of the top surface portion of the funnel and a width of a joint surface of a back surface portion of the screen panel is about 1.2:1.0.

In the flat cathode-ray tube thus arranged so far, on the joint surface of the funnel, the front panel, and the screen panel, upon frit sealing, the funnel is projected from the front panel and the screen panel toward the inside of the cathode-ray tube to form a level-difference portion for storing fused frit over the whole inner peripheral edge of the joint surface. Therefore, the frit fused under heat and pressure in the frit sealing process is cooled, and crystallized in this level-difference portion, and covers the whole inner peripheral edge of the joint surface as a continuous sealing member, thereby preventing air-leakage from occurring.

DETAILED DESCRIPTION OF THE PREFERRED EMBODIMENT

A flat cathode-ray tube according to the present invention will be described below with reference to the accompanying drawings.

Figure 2B:
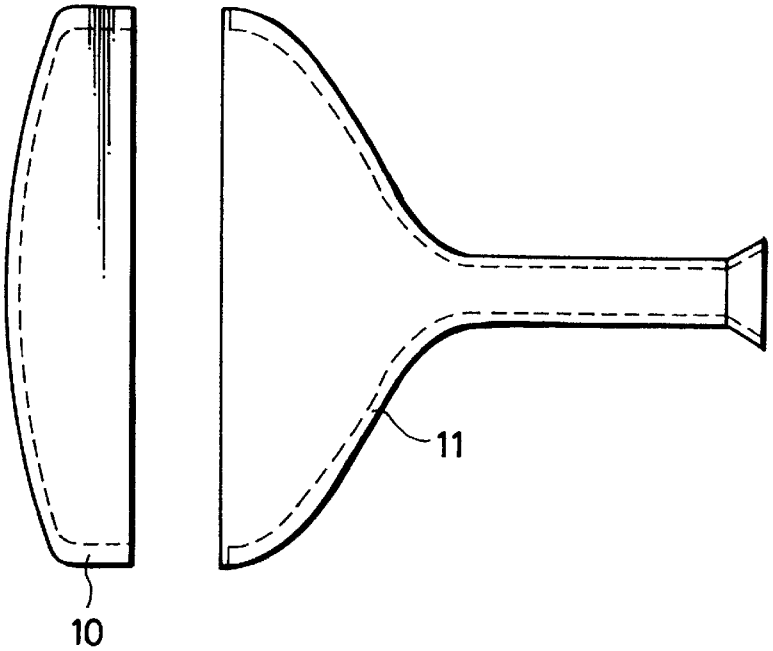
FIG. 2B (RELATED ART)
FIG. 2B is a plan illustrating an ordinary cathode-ray tube with a glass tube body of a two-component structure.
Figure 2A:
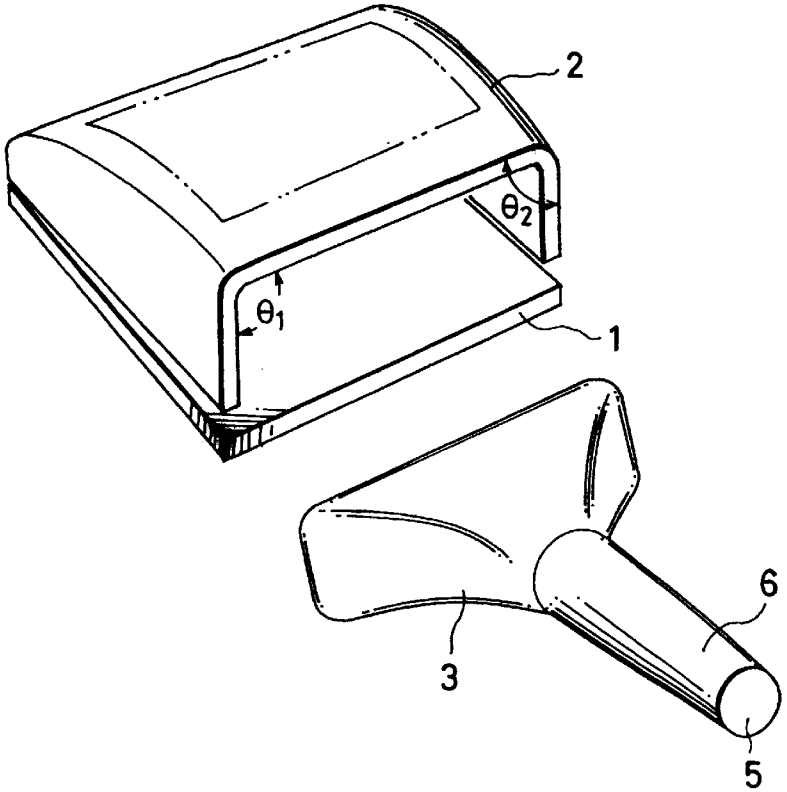
FIG. 2A (RELATED ART)
FIG. 2A is a perspective illustrating a flat cathode-ray tube with a glass tube body of a three-component structure.
Figure 3:
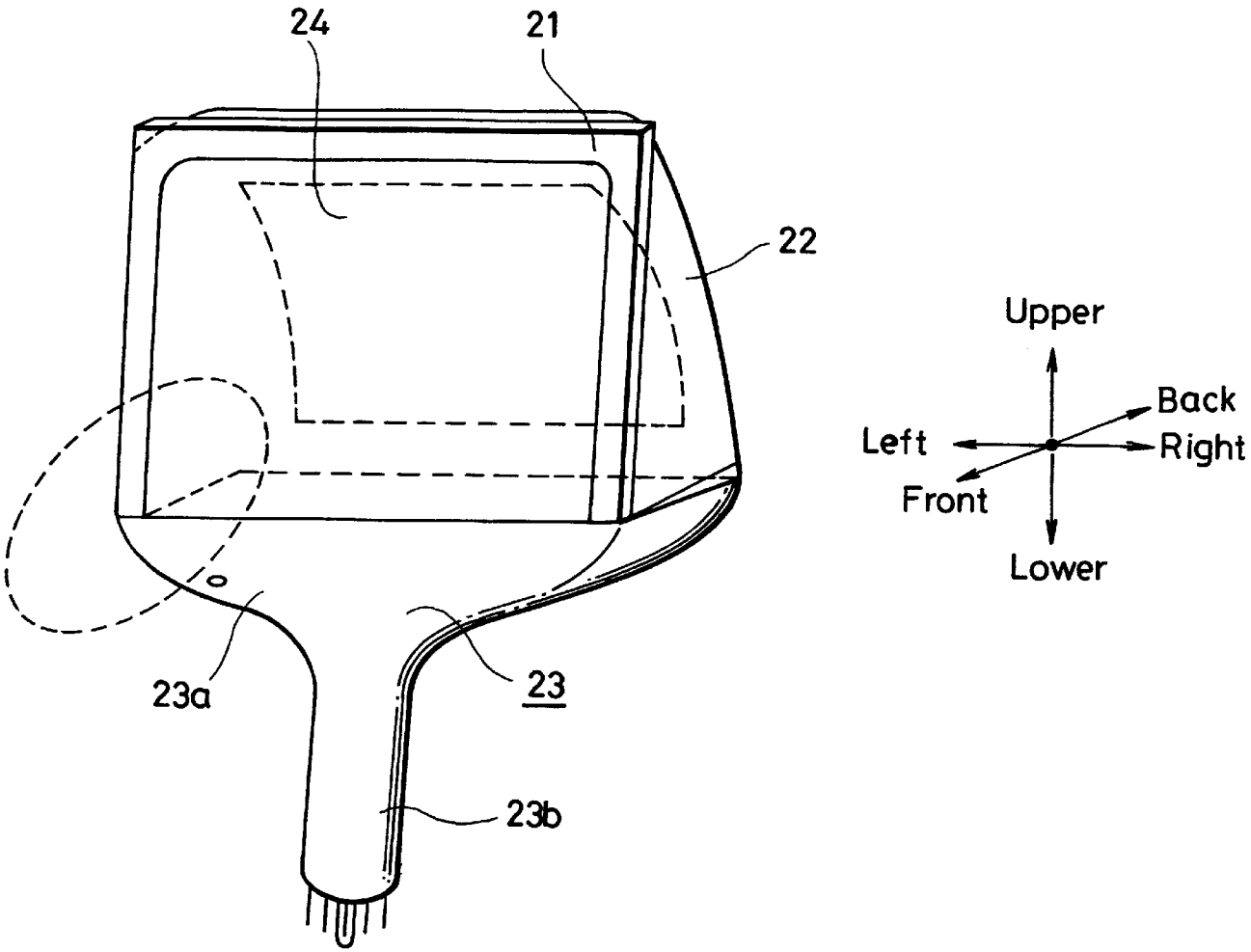
FIG. 3 is a perspective view illustrating a shape of a screen panel, and a shape of a funnel of a flat cathode-ray tube of a three-component structure according to the present invention.

FIG. 3 is a perspective view illustrative of a flat cathode-ray tube according to the present invention. The flat cathode-ray tube shown in FIG. 3 is a 4-inch flat cathode-ray tube with a fluorescent screen of which the diagonal is about 4 inches (about 101 mm) long. The glass tube body of the flat cathode-ray tube shown in FIG. 3 is of the three-component structure comprising a planar front panel 21, a screen panel 22, and a funnel 23 in the same manner as in the flat cathode-ray tube shown in FIG. 2A.

The planar front panel 21 is made of a transparent glass of which major surface is flat (e.g., glass which is generally referred to as a "monochrome CRT glass" or "color CRT glass").

The screen panel 22 is made of a translucent glass of similar kind, and has a fluorescent screen 24 formed on its inner side surface. When the front panel 22 is in the form of planar front panel according to the present invention, it is unavoidable that the screen panel 22 becomes relatively long in the upper and lower direction.

The funnel 23 is made of an opaque glass of similar kind, and comprises a funnel portion 23*a* and a neck portion 23*b* which are integrally formed therewith. A deflection yoke (not shown) is disposed outside the funnel portion 23*a,* and an electron gun (not shown) is disposed within the neck portion 23*b*.

When specifying positions/directions of the respective parts of this flat cathode-ray tube in the description below, the upper, lower, left, right, front and back directions are determined based on viewer's eyes shown by an open arrow in FIG. 3 in the form of a compass card-like diagram on the right-hand side of FIG. 3.

In the flat cathode-ray tube shown in FIG. 3, the fluorescent screen 24 is formed on the inner side surface of the screen panel 23, and when this flat cathode-ray tube is in use, the viewer watches an image focused on the fluorescent screen 24 formed on the inner side surface of the screen panel 22 through the planar front panel 21 as shown by the open arrow in FIG. 3. The flat cathode-ray tube according to this invention is of the three-component structure as shown in FIG. 2A, in which the planar front panel 21, the screen panel 22 and the funnel 23 are manufactured separately, and fixed to one another by frit paste.

Specific features of the shape of the screen panel 22 (see FIGS. 4A, 4B, 4C) and specific features of the shape of the funnel 23 (see FIGS. 5A, 5B) of the three-component structure of the glass tube bodies of the flat-cathode ray tube shown in FIG. 3 will be described below.

Figure 4A:
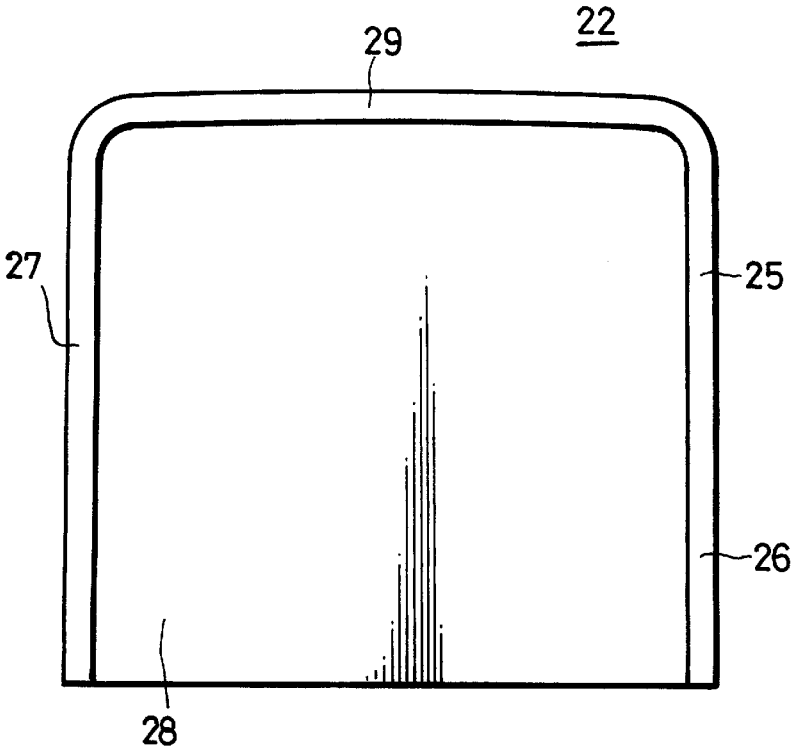
FIG. 4A is a front view illustrating the shape of the screen panel of the flat cathode-ray tube shown in FIG. 3.
Figure 4B:
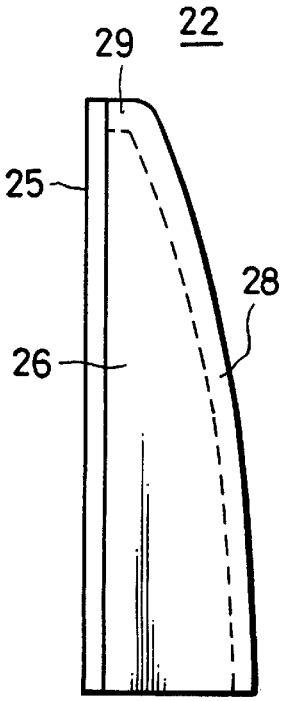
FIG. 4B is a right-hand side elevational view thereof.
Figure 4C:
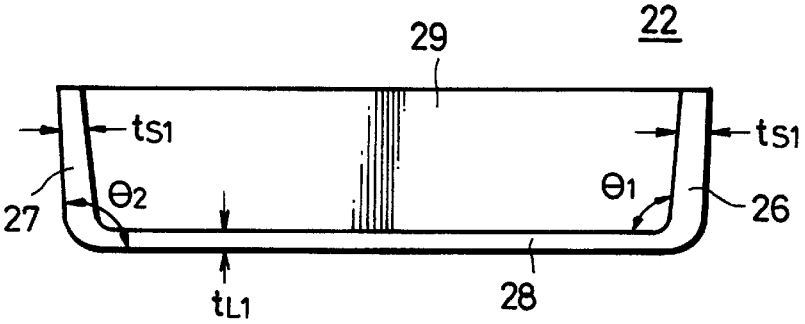
FIG. 4C is a bottom view thereof.

FIG. 4A is a front view of the screen panel 22, FIG. 4B is a right-hand side elevational view thereof, and FIG. 4C is a bottom view thereof.

As illustrated, the screen panel 22 comprises a right-hand side wall portion 26, a left-hand side wall portion 27, a top surface portion 29, and a back surface portion 28 which joins the right-hand side wall portion 26, the left-hand side wall portion 27, and the top surface portion 29. The right-hand side and left-hand side wall portions 26, 27 will be referred to as "skirt portions 26, 27" for the sake of brevity, respectively. An end face portion (inverted U-like frame portion) 25 shown in the front view (FIG. 4A) is sealed to a peripheral edge portion of the back major surface of the planar front panel 21 by frit when the right-hand side wall portion 26, the left-hand side wall portion 27, the top surface portion 29 and the back surface portion 28 are joined.

As is clear from the bottom view of FIG. 4C, angles $\theta_1$, $\theta_2$ formed by the right-hand or left-hand side wall portion 26 or 27 and the back surface portion 28 are obtuse angles slightly larger than a right angle. The angles $\theta_1$ and $\theta_2$ are 95 degrees, for example, in the form of an internal angle θ1 formed by the inner circumferential surface, and 93 degrees, for example, in the form of an external angle θ2 formed by an outer circumferential surface. The reason that any of the angles θ is selected to be an obtuse angle larger than the right angle is to easily extract the screen panel 22 from the plunger used in press-treatment when the screen panel 22 is manufactured. The angles θ have to be the obtuse angle larger than the right angle particularly when the skirt portions 26, 27 are relatively long.

A difference between the angles θ1 and θ2 is used to taper the right-hand side wall portion 26 and the left-hand side wall portion 27. The right-hand side wall portion 26 and the left-hand side wall portion 27 are progressively tapered from their connected portions with the back surface portion 28 toward their connected portions with the planar front panel 21, and hence the screen panel 22 can be easily detached from the plunger.

Figure 5A:
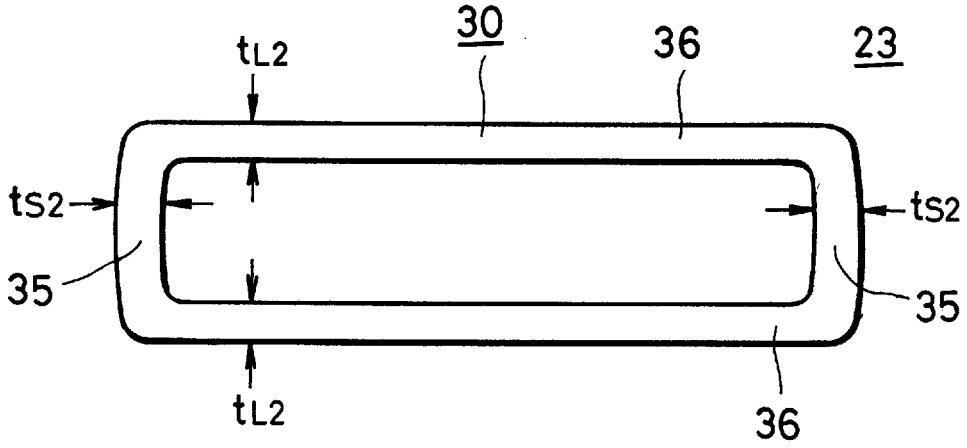
FIG. 5A is a plan view illustrating the shape of the screen panel of the flat cathode-ray tube shown in FIG. 3.
Figure 5B:
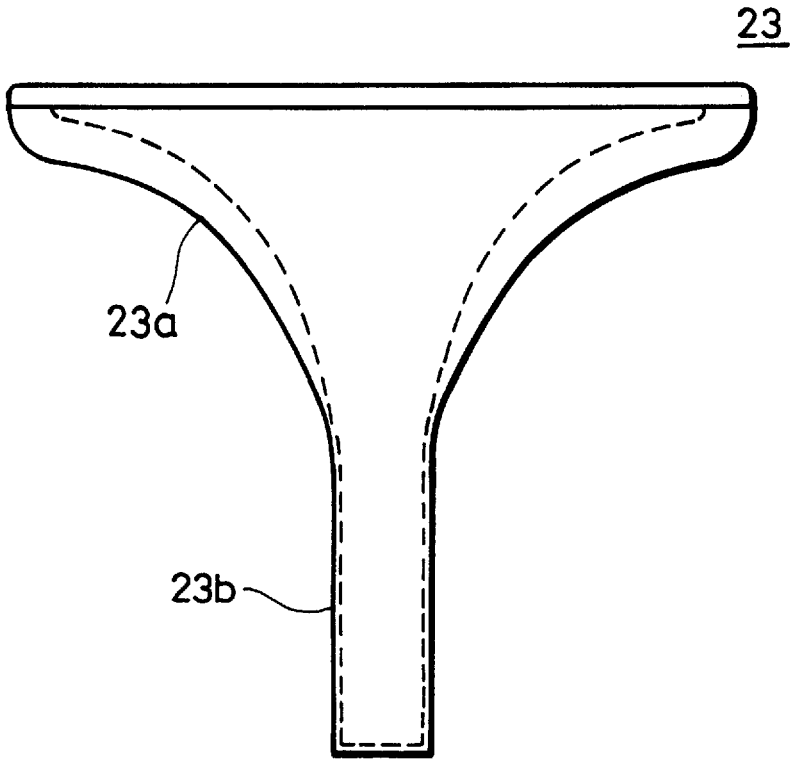
FIG. 5B is a front view thereof.

FIG. 5A is a plan view of the funnel 23, and FIG. 5B is a front view thereof. As illustrated, the funnel 23 comprises the funnel portion 23*a* and the neck portion 23*b*. A deflection yoke (not shown) is disposed outside the funnel portion 23*a* and an-electron gun (not shown) is disposed within the neck portion 23*b*. As shown in the front view (FIG. 5A), a top surface portion (shaped as a square frame) 30 of the funnel 23 is in the form of axial symmetry with respect to horizontal and vertical lines crossing the center thereof for convenience sake of molding in press-treatment.

The most specific feature of the flat cathode-ray tube according to the present invention lies in that the funnel 23 is inwardly protruded from the front panel 21 and the screen panel 22 at the joint surfaces of the funnel 23, which serves as a base, and the front panel 21 and the screen panel 22 fixed to the funnel 23. To realize the above-mentioned arrangement, a ratio between a width $t_{S2}$ of the sealed surface of the short side 35 of the square frame 30 (FIG. 5D) of the top surface portion of the funnel 23 and a width $t_{S1}$ of the sealed surfaces of the side wall portions 26, 27 (FIG. 4C) of the screen panel 22 is about 1.5:1.0 (such ratio was about 1.0:1.0 according to the related art).

More preferably, of the joint surfaces between the funnel 23 and the screen panel 22, a ratio between a width $t_{L2}$ of the joint surface of a long side 36 of the rectangular frame 30 (FIG. 5A) of the top surface portion of the funnel 23 and a width $t_{L1}$ of the joint surface of the back surface portion 28 (FIG. 4C) of the screen panel 22 is about 1.2:1.0 (such ratio was about 1.0:1.0 according to the related art).

The ratio between the width $t_{S2}$ of the joint surface of the short side 35 of the funnel 23 and the width $t_{S1}$ of the joint surface of the screen panel 22 is about 1.5:1.0 as described above. If the glass thickness $t_{S2}$ of the funnel 23 were too thick because of the above ratio, the funnel glass would not be manufactured with high efficiency satisfactorily. In such case, the above-mentioned ratio may be changed as follows.

That is, of the joint surfaces between the funnel 23 and the screen panel 22, the width $t_{L2}$ of the joint surface of the long side 36 of the rectangular frame 30 (FIG. 5A) of the top surface portion of the funnel 23 is made relatively larger than the width $t_{L1}$ of the joint surface of the back surface portion 28 of the screen panel 22, and the ratio between the width $t_{S2}$ of the joint surface of the short side 35 of the funnel 23 and the width $t_{S1}$ of the joint surface of the side wall portions 26, 27 of the screen panel 22 is selected to be less than about 1.5:1.0.

The three components, i.e., the planar front panel 21, the screen panel 22 and the funnel 23, of the flat cathode-ray tube according to the present invention are frit-sealed as follows.

When the planar front panel 21 and the screen panel 22 are sealed, a frit paste is coated on the end face portion 25 (FIG. 4A) of the screen panel 22, and the screen panel 22 is joined to the peripheral edge portion of the back major surface of the planar front panel 21 by frit. Concurrently therewith, when the planar front panel 21, the screen panel 22 and the funnel 23 are joined one another by frit, a frit is coated on the top surface portion 30 (FIG. 5A) of the funnel 23, and the funnel 23 is joined to the planar front panel 21 and the screen panel 22 by frit.

Figure 6A:
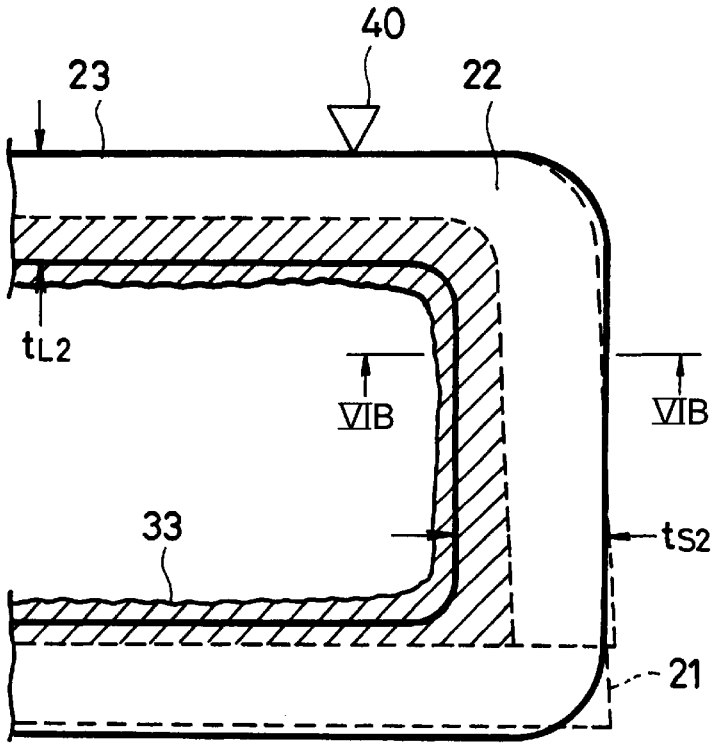
FIG. 6A is a fragmentary plan view, partly in cross section, illustrating a rear right-hand side portion of sealed surfaces of a planar front panel, a screen panel, and a funnel of the flat cathode-ray tube according to the present invention.

The process for joining the three-component structure by frit is the same as the manufacturing process described in the related art. Specifically, after a frit paste is coated on the planar front panel 21, the screen panel 22, and the funnel 23, they are held in the same attitude as they are held when the flat cathode-ray tube 1 is in use as shown in FIG. 3, and their positions are determined based on left and right two positioning marks shown by open-inverted-delta 40 in FIG. 6A. Only one positioning mark 40 is shown in FIG. 6A. Thereafter, the planar front panel 21, the screen panel 22, and the funnel panel 23 are heated under pressure, and the frit paste is fused and crystallized to fix the joint surface. In that case, a part of fused frit paste overflows from the joint surface. Thereafter, an electron gun (not shown) is disposed within the neck portion 23*b*, and a stem portion (neck-open-end) and the neck portion 23*b* are shielded. Then, the inside of the flat cathode-ray tube is evacuated.

A positional relationship obtained from the joint surfaces of the planar front panel 21, the screen panel 22, and the funnel 23 comprising the flat cathode-ray tube after joining will be described with reference to FIGS. 6A to 6C, and FIGS. 7A to 7C.

Figure 6B:
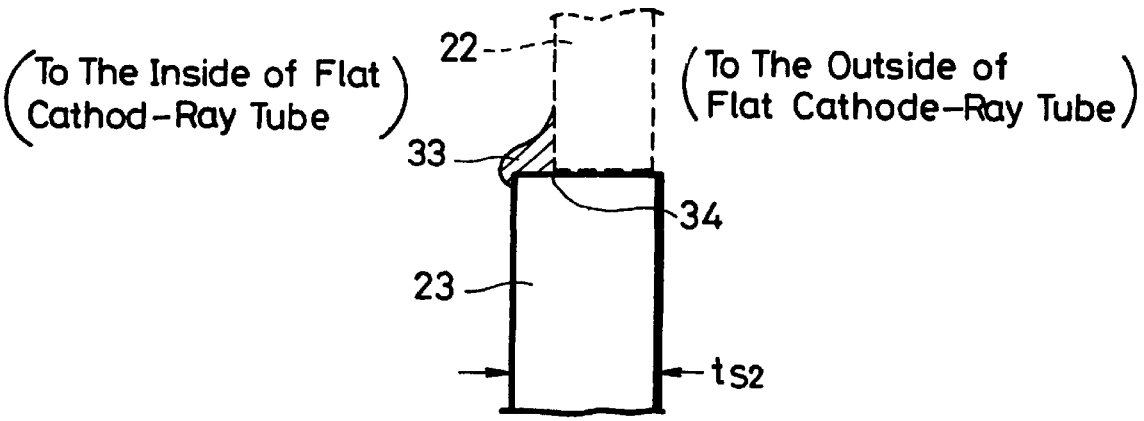
FIG. 6B is a fragmentary cross-sectional view taken along the line C-C' in FIG. 6A.
Figure 7A:
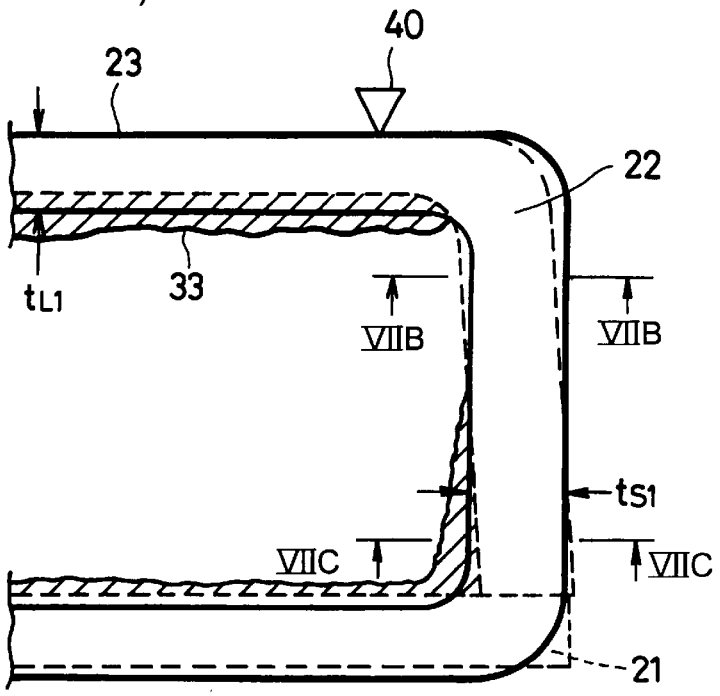
FIG. 7A (PRIOR ART)
FIG. 7A is a fragmentary plan view, partly in cross section, illustrating a rear right-hand side portion of sealed surfaces of a planar front panel, a screen panel, and a funnel of the flat cathode-ray tube of a comparative example according to the related art.
Figure 7B:
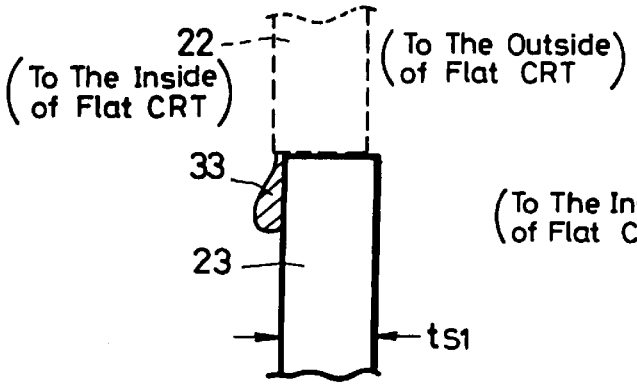
FIG. 7B (PRIOR ART)
FIG. 7B is a fragmentary cross-sectional view taken along the line D-D' in FIG. 7A.
Figure 7C:
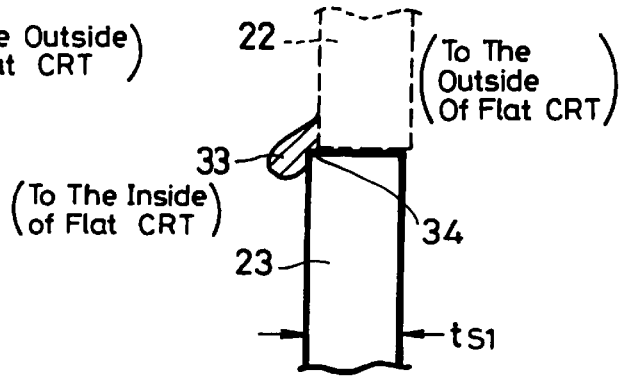
FIG. 7C (PRIOR ART)
FIG. 7C is a fragmentary cross-sectional view taken along the line E-E' in FIG. 7A.

FIG. 6A is a fragmentary plan view, in opened-up fashion, illustrating a rear right-hand portion (shown by hatched elliptical portion) of the sealed surfaces of the planar front panel 21, the screen panel 22, and the funnel 23. FIG. 7A is a fragmentary plan view, in opened-up fashion, illustrating a comparative example of a rear right-hand portion (shown by hatched elliptical portion) of the joint surfaces of the planar front panel 21, the screen panel 22, and the funnel 23, and is used to explain affects achieved by the embodiment shown in FIG. 6A. FIG. 6B is a cross-sectional view taken through the line C-C' in FIG. 6A. FIG. 7B is a cross-sectional view taken through the line D-D' in FIG. 7A, and FIG. 7C is a cross-sectional view taken through the line E-E' in FIG. 7A.

Throughout FIGS. 6A to 7C, a bold solid line shows the shape (see FIG. 7A) of the top surface portion of the funnel 23 serving as a mount, broken lines show a shape (see FIG. 4C) of the bottom portion of the screen panel 22 mounted on the funnel 23 and a shape (see FIG. 3) of the bottom portion of the planar front panel 21, and hatched areas show frit-overflowed portions 33 with frit paste overflowed from the planar front panel 21, the screen panel 22, and the funnel 23 during the frit-seal process and which are then cooled and crystallized. The above frit-overflowed portion 23 will be referred to as a "sealing member 33".

Although not shown in FIGS. 6A, 7A, the sealing member 33 of a small amount is formed along the outer periphery of the sealed surface. In this case, such sealing member 33 is produced on the outer peripheral surface of the flat cathode-ray tube convexities, and degrades the external appearance of the flat cathode-ray tube. Therefore, the amount of overflowed-frit should preferably be limited, and there have been devised various methods of coating frit paste such that the sealing member 33 is dominantly formed on the inner peripheral surface of the joint surfaces as shown in FIGS. 6A, 7A.

A progress in which the joint surface shape according to the related art (FIG. 7A) is varied to the joint surface shape (FIG. 6A) that has been described in "Features of flat cathode-ray tube according to the present invention" will be described below.

Inventors of the present invention have searched a portion from which a defect, such as air-leakage from the outside to the inside of the flat cathode-ray tube, occurred, analyzed a cause of such air-leakage, and discovered that the air-leakage is caused by sizes of two members on the joint surface and a joint interrelationship between the two members.

A manner in which the portion of the air-leakage was discovered will be described with reference to FIGS. 7A, 7B, 7C.

FIG. 7A shows a comparative example of the flat cathode-ray tube in which the air-leakage occurred. Having examined the defect portion of the air-leakage, it was found out that such defect portion of the air-leakage occurred at the sealed portion shown by the line D-D' in FIG. 7A.

Having examined the cross section of the air-leakage portion, as is clear from FIG. 7B which is the cross-sectional view taken along the line D-D' in FIG. 7A, the funnel 23 is withdrawn toward the outside (right-hand side in FIG. 7B) of the flat cathode-ray tube compared with the screen panel 22. As a consequence, upon frit-sealing, a fused frit overflowed from the sealed surface between the screen panel 22 and the funnel 23 is directly overflowed downwardly, cooled and crystallized with the result that the sealing member 33 covered, not the joint surface, but the side surface portion of the funnel 23.

Accordingly, in this portion, it is estimated that only the cooled frit lying between the funnel 23 and the screen panel 22 functions to prevent the air-leakage, the sealing member 33 does not substantially contribute to the action for preventing the air-leakage, and that the air-leakage preventing function is lowered.

On the other hand, having detected a portion without air-leakage from the defective flat cathode-ray tube of the comparative example shown in FIG. 7A, it is to be understood that such portion without air-leakage is the portion at the line E-E' of the joint surface of FIG. 7A. When the cross-section of such portion is observed, as shown in FIG. C, the funnel 23 is slightly protruded toward the inside (left-hand side in FIG. 7C) of the flat cathode-ray tube compared with the screen panel 22. Then, it was confirmed that the funnel 23 and the screen panel 22 produce a level-difference portion 34 therebetween, and this level-difference portion 34 functions to prevent the fused frit overflowed upon frit-sealing from being directly flowed downwardly while the fused frit was being cooled and crystallized, and covered the joint surface along the inner periphery of the joint surface.

Accordingly, in the above portion, in addition to the cooled frit lying between the funnel 23 and the screen panel 22, the sealing member 33 of frit also functions to prevent the air-leakage, and it was estimated that the air-leakage preventing function was improved.

Therefore, the inventors of the present invention have found out that, when the funnel 23 is protruded toward the inside of the flat cathode-ray tube compared with the screen panel 22 and the planar front panel 21 mounted on the funnel 23 to form the fused frit storage level-difference portion 34 along the whole of the inner periphery of the joint surface, thereby storing the fused frit as the sealing member 33 as shown in FIG. 7C, such level-difference portion 34 is effective in preventing the air-leakage. Thus, the inventors of the present invention have developed the flat cathode-ray tube according to the present invention shown in FIG. 6A.

In the flat cathode-ray tube shown in FIG. 6A, the sealing member 33 is continuously formed along the whole of the inner peripheries of the joint surfaces of the bottom portion of the planar front panel 21, the bottom portion of the screen panel 22 and the top surface portion of the funnel 23. Having examined the cross section of the joint surface, as is clear from FIG. 6B which is a cross-sectional view taken along the line C-C' in the joint surface of FIG. 6A, the sealing member 33 can be prevented by the level-difference portion 34 from directly flowed downwardly in the frit-seal process, and cooled and crystallized to cover the joint surface along the full length of the inner peripheral edge of the joint surface. As a result, a leakage of air from the outside to inside of the flat cathode-ray tube can be prevented sufficiently.

Comparing the flat cathode-ray tube (FIG. 6A) according to the present invention with the flat cathode-ray tube (FIG. 7B) according to the related art (comparative example), the inventive flat cathode-ray tube has the sealing member 33 formed so as to cover the full length of the inner peripheral edge of the joint surface, and the flat cathode-ray tube according to the comparative example has the sealing member 33 which is not continuously formed over the whole of the inner peripheral portion of the joint surface, i.e., interrupted partly. In this portion in which the sealing member 33 is interrupted, the sealing member 33 of frit is fixed to the side surface side of the funnel 23. Therefore, if this level-difference portion 34 for storing fused frit is formed along the full length of the inner periphery of the joint surface, then even when the size of the flat cathode-ray tube is different, and positioning tolerances obtained when the three components, i.e., planar front panel, the screen panel, and the funnel, are manufactured or assembled are different, the air-leakage can be prevented from being caused or it can be decreased considerably.

A specific means for forming the level-difference portion 34 is devised in consideration of that the shapes of the planar front panel, the screen panel, and the funnel of the flat cathode-ray tube according to the related art are modified as less as possible and that a required cost can be reduced.

(a) The outer size of three-component structure of planar front panel, screen panel, and funnel are not changed at all;

(b) The most effective means is to increase the thickness of the short side of the joint surface 30 (see plan view of FIG. 5A) of the funnel 23 toward the inside of the flat cathode-ray tube (i.e., increase the width); and (c) It was confirmed that to increase the thickness (i.e., increase the width) of the long side 36 of the joint surface 30 of the funnel 23 toward the inside of the flat cathode-ray tube is also effective ($t_{L1} \rightarrow t_{L2}$).

In the 4-inch flat cathode-ray tube according to the present invention, in consideration of present technique glass manufacturing tolerance of ±0.4 mm and present assembly tolerance of ±0.5 mm, the joint surface 30 of the funnel 23 was changed in shape such that the thickness $t_{S1}$ (FIG. 7A) of the short side 35 was increased about 50%, i.e., changed to the thickness $t_{S2}$ (FIG. 6A). Further, to ensure that the flat cathode-ray tube can be prevented from being affected by air leakage, the thickness $t_{L1}$ (FIG. 7B) of the long side 36 of the flat cathode-ray tube according to the related art was increased about 20 to 30%, i.e., changed to the thickness $t_{L2}$ (FIG. 6A).

Consequently, as compared with a percent defective of air leakage in the flat cathode-ray tube according to the related art was about 1%, a percent defective of air leakage in the flat cathode-ray tube according to the present invention becomes less than 0.1% which is under 1/10 of 1%. Thus, the air leakage can be prevented from being produced substantially, and a yield of flat cathode-ray tube could be improved. Also, frit paste need not be coated one more time, and the frit-seal process need not be carried out one more time because air leakage in the flat cathode-ray tube can be avoided. Therefore, the flat cathode-ray tube according to the present invention becomes highly reliable.

Figure 1:
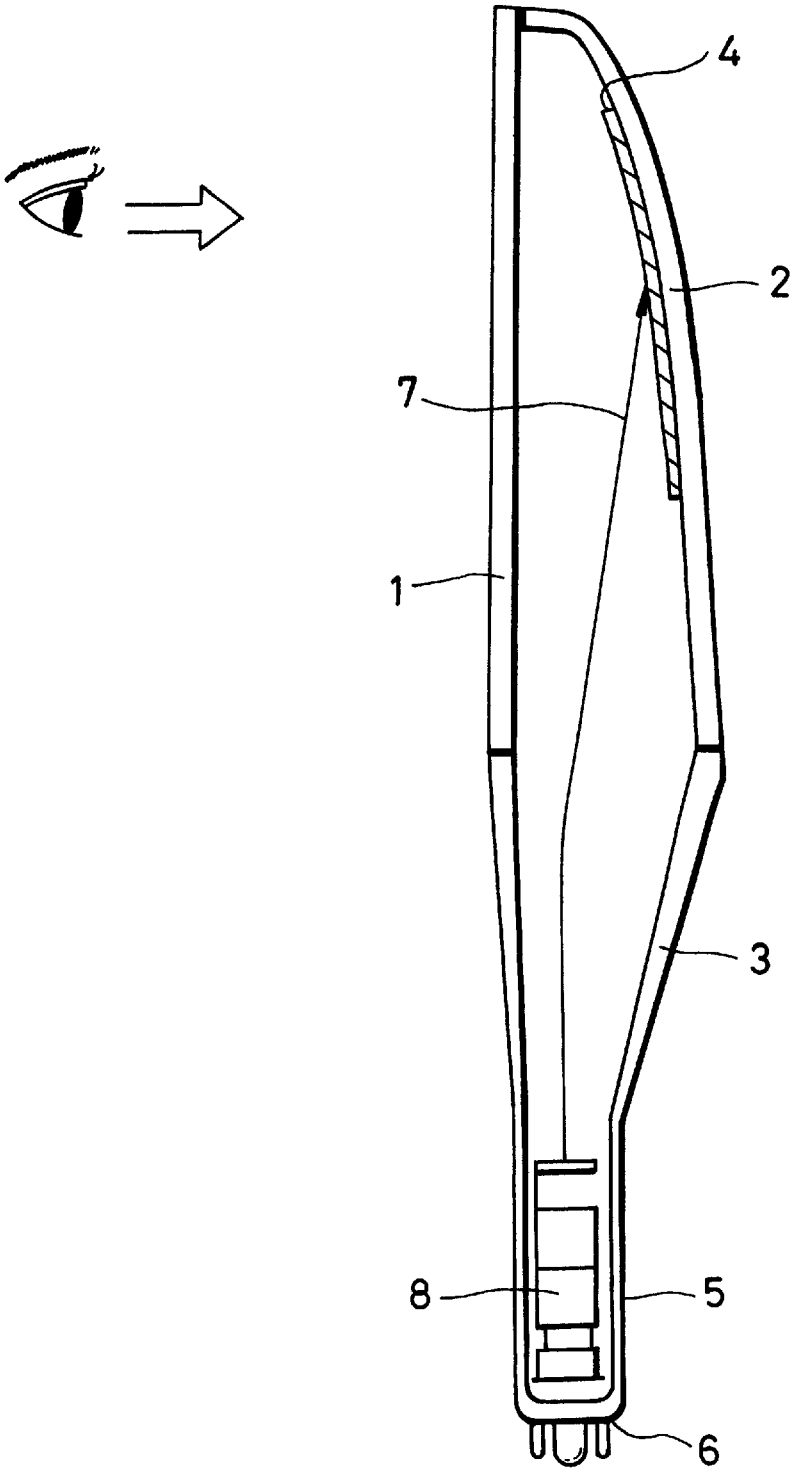
FIG. 1 (RELATED ART)
FIG. 1 is a right-hand side elevational view, partly in cross section, used to explain a flat cathode-ray tube according to the related art.

While the flat cathode-ray tube according to the present invention has been described so far, the present invention is not limited thereto, and the following variants are also possible. That is, while the principle of the present invention has been applied to the flat cathode-ray tube of reflection type, the principle of the present invention can also be applied to a flat cathode-ray tube of transmission type because the three-component structure of glass tube of the flat cathode-ray tube of transmission type is not different from that of the flat cathode-ray tube of reflection type. Moreover, the flat cathode-ray tube of three-component structure is held in the attitude shown in FIG. 1 when it is in use, and hence the level-difference portion is formed by increasing the thickness of the funnel located at the lower portion of the flat cathode-ray tube. While the flat cathode-ray tube of three-component structure is held and jointed upside down, the level-difference portion may be formed by increasing the thicknesses of the planar front panel and the screen panel which are located at the lower portion of the flat cathode-ray tube.

As is clear from the above description, the present invention can achieve the following effects:

According to the present invention, the occurrence of defective sealing can be decreased, and the occurrence of resultant air leakage can also be decreased.

Furthermore, according to the present invention, the occurrence of air leakage can be decreased by a minimum modification of a flat cathode-ray tube according to the related art.

Having described a preferred embodiment of the invention with reference to the drawings, it is to be understood that the invention is not limited to that precise embodiment and that various changes and modifications could be effected therein by one skilled in the art without departing from the spirit or scope of the invention as defined in the appended claims.

What is claimed is:

1. A flat cathode-ray tube comprising:

a planar front panel;

a screen panel with a fluorescent screen formed on an inner side surface;

a funnel having an inward protrusion from a joint surface between said planar front panel and said screen panel and frit on the protrusion.

2. A flat cathode-ray tube according to claim 1, wherein, for the joint surfaces between said funnel and said screen panel, a ratio between a width of a joint surface of a short side of a rectangular joint surface of a top surface portion of said funnel and a width of a joint surface of a side wall portion of said screen panel is about 1.5:1.0.

3. A flat cathode-ray tube according to claim 1, wherein, for the joint surfaces between said funnel and said screen panel, a ratio between a width of a long side of a rectangular joint surface of said top surface portion of said funnel and a width of a joint surface of a back surface portion of said screen panel is about 1.2:1.0.

4. A flat cathode-ray tube according to claim 1, wherein, for the joint surfaces between said funnel and said screen panel, a width of a joint surface of a long side of the rectangular joint surface of said top surface portion of said funnel is larger than a width of a joint surface of a back surface portion of said screen panel, and a ratio between a width of a short side of a rectangular joint surface of said top surface portion of said funnel and a width of a joint surface of a side wall portion of said screen panel is less than approximately 1.5:1.0.

5. A flat cathode-ray tube according to claim 1, wherein said flat cathode-ray tube is a 4-inch flat cathode-ray tube.

6. A flat cathode-ray tube comprising:

a planar front panel having a first thickness;

a screen panel having a second thickness; and a funnel having a thickness larger than those of said planar front panel and said screen panel, said funnel being fixed to said planar front panel and said screen panel.

7. A flat cathode-ray tube according to claim 6, wherein said front panel and said screen panel have outer edges coincident with an outer edge of said funnel.

8. A flat cathode-ray tube according to claim 7, wherein said front panel, said screen panel, and said funnel are joined by coating a frit paste on a level-difference portion formed at an inner surface.

9. A flat cathode-ray tube according to claim 6, wherein said funnel has a thickness that is thicker than that of said front panel which is from approximately 10% to approximately 50%.

10. A flat cathode-ray tube comprising a substantially planar front panel;

a screen panel having a fluorescent screen formed on an inner side surface;

said planar front panel and screen panel forming an upper assembly;

a funnel attached to the upper assembly, said funnel having an opening with a perimeter having at least one side which is adjacent a corresponding side of the upper assembly where there is a substantial difference in thickness between the corresponding side of the upper assembly and the side of the funnel such that the difference in thickness forms a protrusion on which frit is formed.

11. The flat cathode-ray tube of claim 10, wherein two edges of the funnel are thicker than a thickness of two corresponding edges of the upper assembly.

12. The flat cathode-ray tube of claim 11, wherein an extra thickness of the funnel forms an inward, protrusion where frit is formed.

* * * * *

UNITED STATES PATENT AND TRADEMARK OFFICE

CERTIFICATE OF CORRECTION

PATENT NO. : 5,831,381

DATED : November 3, 1998

INVENTOR(S) : Toshio Miura and Yoji Kono

It is certified that error appears in the above-identified patent and that said Letters Patent is hereby corrected as shown below:

In claim 1, line 7, after "protrusion" insert --wherein the inward protrusion is formed at least substantially around a perimeter of the funnel.--

In claim 10, line 14, after "protrusion" insert --, and wherein the protrusion is formed at least substantially around a perimeter of the funnel.--

Signed and Sealed this

Seventh Day of March, 2000

*Attest:*

*Attesting Officer*

Q. TODD DICKINSON

*Commissioner of Patents and Trademarks*